US011017967B2

(12) United States Patent
Montich

(10) Patent No.: US 11,017,967 B2
(45) Date of Patent: May 25, 2021

(54) DISTRIBUTION GROUNDING SWITCH TO SUPPORT DISTRIBUTED ENERGY RESOURCES

(71) Applicant: EMA Electromechanics, Inc., Sweetwater, TX (US)

(72) Inventor: Eduardo Montich, Sweetwater, TX (US)

( * ) Notice: Subject to any disclaimer, the term of this patent is extended or adjusted under 35 U.S.C. 154(b) by 0 days.

(21) Appl. No.: 16/884,673

(22) Filed: May 27, 2020

(65) Prior Publication Data

US 2020/0411260 A1 Dec. 31, 2020

Related U.S. Application Data

(63) Continuation-in-part of application No. 16/571,580, filed on Sep. 16, 2019, now Pat. No. 10,784,063, which is a continuation-in-part of application No. 16/455,306, filed on Jun. 27, 2019, now Pat. No. 10,672,573.

(51) Int. Cl.

| | |
|---|---|
| ***H01H 33/53*** | (2006.01) |
| ***H01H 33/66*** | (2006.01) |
| ***H01H 33/662*** | (2006.01) |
| ***H01H 33/664*** | (2006.01) |
| ***H01H 33/666*** | (2006.01) |

(52) U.S. Cl.

CPC ..... *H01H 33/666* (2013.01); *H01H 33/53* (2013.01); *H01H 33/662* (2013.01); *H01H 33/664* (2013.01); *H01H 33/6606* (2013.01)

(58) Field of Classification Search

CPC ..... H01H 33/12; H01H 33/53; H01H 33/666; H01H 33/6606; H01H 33/662; H01H 33/664; H01H 31/003; H01H 31/02; H01H 31/04; H01H 31/10; H01H 9/12; H01H 9/443; H01H 9/16; H01H 33/66; H01H 33/52; H01H 33/6662; H01H 2033/6667; H01H 31/006

USPC ..... 218/55, 5–7, 9–10, 12, 79–80, 119, 140, 218/152–154; 316/115

See application file for complete search history.

(56) References Cited

U.S. PATENT DOCUMENTS 4,538,039 A * 8/1985 Gotoh ..... H01H 33/12 218/10

5,452,170 A * 9/1995 Ohde ..... H01H 33/596 174/DIG. 17

(Continued)

*Primary Examiner* — William A Bolton

(74) *Attorney, Agent, or Firm* — Egbert Law Offices, PLLC

(57) ABSTRACT

A distribution grounding switch for an electricity distribution network has a first electrical terminal adapted connectable to a mains line, a second electrical terminal connectable to a lateral line, a first vacuum bottle having a pair of contactors therein, a second vacuum bottle having a pair of contactors therein, and a magnetic linkage cooperative with one of the pair of contactors of the first vacuum bottle and one of the pair of contactors of the second vacuum bottle so as to cause the pair of contactors of the first vacuum bottle the close while generally simultaneously causing the pair of contactors of the second vacuum bottle to open. The mechanical linkage also causes the pair of contactors of the first vacuum bottle to open generally simultaneously with the closing of the pair of contactors of the second vacuum bottle.

16 Claims, 5 Drawing Sheets

(56) References Cited

U.S. PATENT DOCUMENTS

| | | | | |
|---|---|---|---|---|
| 5,905,242 | A * | 5/1999 | Bernard | H01H 33/6661 218/154 |
| 7,091,439 | B2 * | 8/2006 | Vaghini | H01H 33/6661 218/154 |
| 7,687,937 | B2 | 3/2010 | Lasseter | |
| 7,705,262 | B2 * | 4/2010 | Allaire | H01H 33/36 218/2 |
| 7,724,489 | B2 * | 5/2010 | Montich | H01H 31/003 361/115 |
| 7,902,479 | B2 * | 3/2011 | Tsuchiya | H01H 33/66207 218/120 |
| 8,097,980 | B2 | 1/2012 | Cyrus | |
| 8,466,581 | B2 | 6/2013 | Kuran | |
| 8,473,250 | B2 | 6/2013 | Adest | |
| 8,816,535 | B2 | 8/2014 | Adest | |
| 10,230,310 | B2 | 3/2019 | Loewenstern | |
| 2009/0120907 | A1 * | 5/2009 | Girodet | H01H 33/52 218/5 |
| 2010/0089874 | A1 * | 4/2010 | Morita | H01H 9/22 218/154 |
| 2012/0280570 | A1 | 11/2012 | Smythe | |
| 2015/0021298 | A1 * | 1/2015 | Sawada | H01H 31/003 218/140 |

* cited by examiner

DISTRIBUTION GROUNDING SWITCH TO SUPPORT DISTRIBUTED ENERGY RESOURCES

CROSS-REFERENCE TO RELATED APPLICATIONS

The present application is a continuation-in-part of U.S. patent application Ser. No. 16/571,580, filed on Sep. 16, 2019, and entitled "Air Insulated Grounding Switch", presently pending. U.S. patent application Ser. No. 16/571,580 is a continuation-in-part of U.S. patent application Ser. No. 16/455,306, filed on Jun. 27, 2019, and entitled "Gas Insulated Grounding Switch", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to grounding and/or transfer switches. More particularly, the present invention relates to grounding switches are used in association with a single and multi-phase power system. More particularly, the present invention relates to the control of distributed energy resources and/or associated loads.

2. Description of Related Art Including Information Disclosed Under 37 CFR 1.97 and 37 CFR 1.98

In the U.S. and around the world, the demand for electrical power continues to grow. At the same time, aging transmission and distribution systems remain subject to occasional failures. Massive failures covering wide geographical areas and affecting millions of people have occurred, even in the United States which has historically enjoyed a relatively robust electrical power system. These problems with the capacity and reliability of the public power grid have driven the development of distributed energy resources. These distributed energy resources are small independent power generation and storage systems which may be owned by, and located near, consumers of electrical power.

One motivating factor is that distributed energy resources can provide more reliable power in critical applications. For example, the distributed energy resources can be a backup to the primary electrical supply. For example, an interruption of power to a hospital can have life-threatening consequences. Similarly, when power to a factory is interrupted, the resulting losses in productivity, wasted material, and other costs, can be catastrophic. In situations like these, the cost of implementing distributed energy resources as a backup can be justified.

Reliability is not only not the only driving factor in the development of distributed energy resources. Power from a distributed energy resource can, in some cases, be sold back to the main power grid. Geographically distributed sources of power, such as wind, solar, or hydroelectric power, may be too limited or intermittent to be used as the basis for a centralized power plant. By harnessing these types of geographically distributed sources using multiple distributed energy resources, these types of power sources can supplement or replace conventional power sources, such as fossil fuels, when the main power grid is available, and can provide backup to their owners when the main power grid is unavailable.

In this context, distributed energy resources have emerged as a promising option to meet consumers' current and future demands for increasingly more reliable electrical power. Power sources for such distributed energy resources are sometimes referred to as "micro-sources" and range in size and capacity from a few kilowatts up to ten megawatts. These micro-sources can include a variety of technologies, both supply-side and demand-side, and they are typically located where the energy is used.

Generally speaking, distributed energy resources can harness two broad categories of electrical power sources. One of these categories is DC sources, such as fuel cells, photovoltaic cells, and battery storage. Another broad category is high-frequency AC sources, such as micro-turbines and wind turbines. Both types of categories of electrical power sources are typically used to provide an intermediate DC voltage that may be produced directly by DC sources and produced indirectly from AC sources (such as by rectification). In both types of sources, the intermediate DC voltage is subsequently converted to AC voltage or current at the required frequency, magnitude, and phase angle for use. In most cases, the conversion from the intermediate DC voltage to the usable AC voltage is performed by a voltage inverter that can rapidly control the magnitude and phase of its output voltage.

Distributed energy resources are typically designed to operate in one of two modes: (1) "isolation" or "island" mode and isolated from the main grid; and (2) normal "grid" mode that is connected to the main grid. For large utility generators, methods have been developed to allow conventional synchronous generators to join and to separate from the main electrical power grid smoothly and efficiently when needed. Because of fundamental differences between distributed energy resources, such as inverter-based micro-sources or small synchronous generators, and centralized energy resources, these existing methods are not suitable to allow distributed energy resources to smoothly and efficiently transition between island mode and grid mode as the distributed energy resources join and separate from the main power grid.

For example, the fundamental frequency in an inverter is typically derived from an internal clock and does not change as the system is loaded. This arrangement is very different from that of a synchronous generator typically used in centralized power systems, in which the inertia from a spinning mass determines and maintains system frequency. Inverter-based micro-sources, in contrast, are effectively inertia-less, so alternative methods must be used to maintain system frequency in an inverter-based micro-source.

Another difference between distributed energy resources and centralized energy resources relates to communication and coordination. A centralized electrical power utility is in a position to monitor and coordinate the production and distribution of power from multiple generators. In contrast, distributed energy resources may include independent producers of power with limited awareness of their communication with each other. Even if the independent producers of power are able to communicate with each other, there may not be any effective way to ensure that they cooperate.

Thus, there is a need for systems for controlling micro-sources in distributed energy resources to ensure these resources can connect to or isolate from the utility grid in a rapid and seamless fashion. There is also a need to independently control reactive and active power. Furthermore, it is important to be able to correct for voltage sag and system imbalances. Further, there is a need for control of the micro-sources based on information available locally at the inverter so that no communication or coordination between micro-sources is necessary. Yet further, there is need for a local controller at the micro-source to enable "plug and play" operation of the micro-source. In other words, there is a need to add micro-sources to a distributed energy system without changes to the control and protection of units that are already part of the system.

It is becoming more and more common to the place solar panels on the roof tops of houses. These solar panels generate electricity, not only for the house where they are mounted, but also for other residences. As such, it becomes a necessity for the utility to control such distributed energy resources. Until recent years, electricity flowed in one way for the utility to manage. Since the utility always had control of the generators, it was easy to turn them on and off whenever desired. Now electricity flows both ways. There are many small generators (homes with solar panels on the roof top) distributed over a wide area. Utilities have no effective switching capacity on such distributed generators. Currently, the utility must rely on the capacity of each solar inverter (including different brands and technologies) to understand what is going on in the grid. In other words, they will have to make a guess as to whether to keep generating or to shut down. As a result, the utilities must rely upon a third-party decision. This poses a huge risk. If the distributed energy generation does not shut down when required by the utility, it can produce an overvoltage or an unsafe condition for the electrical workers. An overvoltage can result in destroying public or private property and creating fires. The unsafe condition for the electrical workers can result in a potential electrocution. As such, a need has developed to be able to send a clear signal to prevent the overvoltage or unsafe conditions in a simple, easy, safe and effective manner.

In the past, various patents have issued relating to the control of the small distributed energy resources. For example, U.S. Pat. No. 7,687,937, issued on Mar. 30, 2010 to Lasseter et al., describes a method of controlling the output inverter of a micro-source and a distributed energy resource system. The system uses unit or zone power controllers that reduce the operating frequency of the inverter to increase its unit output power. This method causes the inverter to reach maximum output power and minimum operating frequency simultaneously.

U.S. Pat. No. 8,097,980, issued on Jan. 17, 2012 to Cyrus et al., provides a distributed solar power plant and a method for connection to the existing power grid. The method includes generating electrical energy from a renewalable form of energy and a plurality of locations at which reside an electrical power line associated with an electrical power grid. The electrical energy generated at each location is transferred to the electrical power line to thereby supply electrical energy to the electric power grid.

U.S. Pat. No. 8,466,581, issued on Jun. 18, 2013 to S. Kuran, discloses a system and method for providing grid-connected utility pole distributed solar power generation. The system includes a utility pole, an inverter, and one or more solar panels. Each of the one or more solar panels is mounted on the utility pole. The method includes receiving solar energy at the solar panels. The solar panels convert the solar energy to direct current. The DC electrical energy is transmitted to an inverter which is also mounted on the utility pole. The inverter is integrated with the solar panels to form an alternating current photovoltaic module.

U.S. Pat. No. 8,473,250, issued on Jun. 25, 2013 to Adest et al., discloses the monitoring of distributed power harvesting systems using DC power sources. A monitoring module is coupled to each side of the power sources or to each string of serially-connected power sources so as to monitor and collect data regarding current, voltage, temperature and other environmental factors at the power source. The collected data is transmitted over a power line to a central analysis station for analysis. Data collected from each source indicates a malfunction or degradation at the source. The comparison of data collected from the same source at different times is indicative of soiling or degradation of the source.

U.S. Pat. No. 8,816,535, issued on Aug. 26, 2014 to Adest et al., provides a protection method in a distributed power system having DC power sources and multiple power modules which include inputs coupled to DC power sources. The power module include outputs coupled in series with one or more of the power modules to form a serial string. An inverter is coupled to the serial string. The inverter converts power input from the string and produces output power. When the inverter stops production of the output power, each of the power modules is shut down and thereby the power input to the inverter is ceased.

U.S. Pat. No. 10,230,310, issued on Mar. 12, 2019 to Loewenstern et al., discloses a safety system for photovoltaic systems. The system includes measuring operational parameters at certain locations within the system and/or receiving messages from control devices indicating a potentially unsafe condition. The system can then be disconnected or short-circuited in response thereto.

U.S. Patent Application Serial No. 2012/0280570, published on Nov. 8, 2012 to Smythe et al., teaches an electrical power distribution installation. There is a plurality of electrical power supply poles supporting sequentially an electric power transmitting cable and take-off for users from the cables. Each of the poles has a lower end embedded in the ground and is supported thereby to extend at least vertically therefrom. The electric power transmitting cables are supported at or near a top of each pole. A panel including solar cells includes solar-to-electric transducers distributed across the panel. Each of the panels is attached to each of the poles. Each has an electric circuit electrically connected to the cells and provides translating of electrical power from the cells to a phase and voltage matching input into the electrical distribution network.

Typically, with circuit breakers, the circuit to the substation can be broken upon application of a manual force to a button or lever of a circuit breaker or by an automatic relay which opens the circuit. Typically, the current is measured to the substation. If any relay senses a problem, the signal is transmitted to the circuit breaker so as to open the breaker. Typically, the relays will be maintained within the substation. The opening of the circuit breaker will prevent energy from being transmitted to the substation. Sometimes, the circuit breaker is open to allow users to work on a wind power system, on the circuit breaker, or on the substation. Typically, the relays will operate if the sensors sense a voltage drop.

The interruption of electrical power circuits has always been an essential function, especially in cases of overloads or short circuits, when immediate interruption of the current flow becomes necessary as a protective measure. In earliest times, circuits could be broken only by separation of contacts in air followed by drawing the resulting electric arc out to such a length that it can no longer be maintained. This means of interruption soon became inadequate and special devices, termed "circuit breakers", were developed. The basic problem is to control and quench the high power arc. This necessarily occurs at the separating contacts of a breaker when opening high current circuits. Since arcs generate a great deal of heat energy which is often destructive to the breaker's contacts, it is necessary to limit the duration of the arc and to develop contacts that can withstand the effect of the arc time-after-time.

A vacuum circuit breaker uses the rapid dielectric recovery and high dielectric strength of the vacuum. The pair of contacts are hermetically sealed in the vacuum envelope. An actuating motion is transmitted through bellows to the movable contact. When the electrodes are parted, an arc is produced and supported by metallic vapor boiled from the electrodes. Vapor particles expand into the vacuum and condense on solid surfaces. At a natural current zero, the vapor particles disappear and the arc is extinguished.

In the past, in association with wind farm systems, when the circuit breakers are open, the collection circuit voltage would be interrupted and a transient overvoltage situation could occur in the collection circuit. In the overvoltage situation, the high transient voltage and the collection circuit line will "backup" through the circuit into the electronics associated with the wind energy generators. As a result, this transient overvoltage could cause damage to the circuitry associated with the energy generators and other circuitry throughout the system. As such, there is a need to hold (within acceptable) limits any overvoltage which occurs when the circuit breaker is to be opened.

When a single line-to-ground fault occurs, there are basically two objectives for protecting the collection circuit. The first objective is clearing the fault from the grid to reduce both the incident energy and the time that personnel and equipment are exposed to the fault current sourced from the transmission system. When the feeder breaker operates first and clears the power generator from the fault, high current from the transmission system is limited in time. However, the temporary overvoltage in the collection circuit can present a problem since the generator is islanded. The second objective is to get the generators to shut down without islanding. This object competes with the first objective of quickly opening the feeder breaker. It takes approximately two hundred milliseconds for the signal to reach the generators in order to shut the generators down. Islanding occurs when all or a portion of the power generated by the power resource becomes electrically isolated from the remainder of the electrical power system. For example, in large collection circuits producing power at twenty-four megawatts separates, severe islanding can occur. Some designers place a grounding transformer on the collection circuit when trying to avoid temporary overvoltage. In certain cases, however, the grounding transformer will not be effective when it comes to reducing temporary overvoltage and subsequent damage to the lightning arrestors. Grounding transformers connected to the collection circuits provide a zero sequence path to ground that does not provide a positive or negative sequence path to ground. Grounding transformers provide a relatively low zero sequence impedance. However, the impedance is not low enough to prevent a severe voltage rise during a fault followed by severe islanding event.

Faults in collection circuits happen and the longer that a fault continues, the more damage will occur. Although communication systems are fast, they do not process information instantaneously. Therefore, communication plays a very important role in protecting the collection circuit. A signal over a dedicated communication channel, such as a fiber, takes time to complete. This delay is called "latency". Delays from the initiation of a fault on the collection circuit to the time when the equipment is separated or isolated from the fault is called "clearing time". When protecting a collection circuit, among the objectives to be accomplished, it is necessary to clear the fault from the grid and to clear the fault from the individual generators. The use of the transfer trip tool can be used. "Transfer trip" means the opening of a circuit breaker from a remote location by means of a signal over a communication line. When using transfer trip, if the fault is cleared by the grid by tripping the feeder breaker as fast as possible and if the feeder breakers take longer than desired, the entire collection circuit is exposed to temporary overvoltage. If the circuit breaker is intentionally delayed in order to match the opening of the circuit breaker and the generator breakers, the feeder is exposed to incident energy and eventually the temporary overvoltage will occur if the delay is not sufficient.

The Federal Energy Regulatory Commission (FERC) has Reliability Standard PRC-024-1. Relay settings in wind and solar power plants must comply with the standard. The standard states that each generator that has generator voltage protective relaying activated to trip its applicable generating unit(s) shall set its protective relaying such that the generator voltage protective relaying does not trip the applicable generating unit(s) as a result of voltage excursion (at the point of interconnection) caused by an event on the transmission system external to the generating plant that remains within a "no trip zone" of a time duration curve. The point of interconnection means that the transmission (high-voltage) side of the generator step-up transformer or collector circuit transformer. Many types of faults occur within or outside of the wind power or solar power plant. An internal fault is considered as a single line fault to ground while an external fault is a three-phase bolted fault. Conventional ground transformers provide no way for the operator to ascertain whether the fault is internal or external. As a result, operation within the "no trip zone" may be required even though the fault is internal of the wind or solar farm. As such, a need has developed in order for the operator to ascertain whether the fault is internal or external of the wind or solar farm system.

In the past, various patents and patent application publications have issued with respect to such circuit breakers. For example, U.S. Pat. No. 5,612,523, issued on Mar. 18, 1997 to Hakamata et al., teaches a vacuum circuit-breaker and electrode assembly. A portion of a highly conductive metal member is infiltrated in voids of a porous high melting point metal member. Both of the metal members are integrally joined to each other. An arc electrode portion is formed of a high melting point area in which the highly conductive metal is infiltrated in voids of the high melting point metal member. A coil electrode portion is formed by hollowing out the interior of a highly conductive metal area composed only of the highly conductive metal and by forming slits thereon. A rod is brazed on the rear surface of the coil electrode portion.

U.S. Pat. No. 6,048,216, issued on Apr. 11, 2000 to Komuro, describes a vacuum circuit breaker having a fixed electrode and a movable electrode. An arc electrode support member serves to support the arc electrode. A coil electrode is contiguous to the arc electrode support member. This vacuum circuit breaker is a highly reliable electrode of high strength which will undergo little change with the lapse of time.

U.S. Pat. No. 6,759,617, issued on Jul. 6, 2004 to S. J. Yoon, describes a vacuum circuit breaker having a plurality of switching mechanisms with movable contacts and stationary contacts for connecting/breaking an electrical circuit between an electric source and an electric load. The actuator unit includes at least one rotary shaft for providing the movable contacts with dynamic power so as to move to positions contacting the stationary contacts or positions separating from the stationary contacts. A supporting frame fixes and supports the switching mechanism units and the actuator unit. A transfer link unit is used to transfer the rotating movement of the rotary shaft to a plurality of vertical movements.

U.S. Pat. No. 7,223,923, issued on May 28, 2007 to Kobayashi et al., provides a vacuum switchgear. This vacuum switchgear includes an electro-conductive outer vacuum container and a plurality of inner containers disposed in the outer vacuum container. The inner containers and the outer container are electrically isolated from each other. One of the inner vacuum containers accommodates a ground switch for keeping the circuit open while the switchgear is opened. A movable electrode is connected to an operating mechanism and a fixed electrode connected to a fixed electrode rod. Another inner vacuum container accommodates a function switch capable of having at least one of the functions of a circuit breaker, a disconnector and a load switch.

U.S. Pat. No. 3,883,706, issued on May 13, 1975 to K. Glaser, describes a multiple rotary wafer type switch with axial bridging contacts and multiple wafer connecting rings. There are at least two circular insulating members each having a central opening. The members are assembled with end faces thereof being in contact and their openings in registry. Radially inwardly extending contact tongues are embedded in the insulating members for cooperation with the rotor having contact bridges arranged in the central openings. An elastically deformable connecting ring is disposed in the central openings and axially overlaps the insulating member.

U.S. Pat. No. 4,016,385, issued on Apr. 5, 1977 to I. Golioto, teaches a high-voltage transfer switch with a cam controlled overlap during transfer. This transfer switch selectively transfers an electrical load from one high-voltage source to another. The transfer switch includes a shaft connected to a handle. There are two circular slotted cams spaced close to opposite ends of the shaft. Cam followers are connected to opposite ends of a follower bar and are inserted in the cam slot. The follower bars connected to the cam follower are connected to vacuum interrupter contacts. The transfer switch is constructed so that as the cam is rotated, the contacts connecting one high-voltage source to the electrical load are closed and as the cam is continued to be rotated, the contactors of the previously connected high-voltage supply are subsequently released.

U.S. Pat. No. 6,462,296, issued on Oct. 8, 2002 to Boettcher et al., describes a circuit breaker arrangement and, in particular, and air-insulated medium-voltage switching arrangement having circuit breaking features, disconnection features and grounding features. The circuit breaker arrangement includes a switching module that is formed from function-oriented modular components. The modular components include a base module component, a pole module component and a drive module component. The base module component is fixedly connected with the drive module component. The pole module component is arranged so as to be movable along a straight line.

U.S. Pat. No. 6,951,993, issued on Oct. 4, 2005 to Kikukawa a et al., provides a vacuum switch having a vacuum container, a grounding switch, and a load switch disposed in a container. An external connection conductor is disposed in the vacuum container and connected electrically inside and outside of the vacuum container. The grounding switch and the external connection conductor are electrically connected to each other in the vacuum container.

U.S. Pat. No. 7,724,489, issued on May 25, 2010 to the present inventor, describes a circuit breaker with a high-speed mechanically-interlocked grounding switch. The subject matter of this patent is described hereinbelow.

U.S. Pat. No. 8,174,812, issued on May 8, 2012 to the present inventor, describes a mechanically interlocked transfer switch that has first, second and third electrical terminals extending outwardly from a housing. A first vacuum bottle is positioned in the housing and has a pair of contactors therein. A second vacuum bottle is positioned in the housing and has a pair of contactors therein. A mechanical linkage is movable between a first position and a second position. The first position electrically connects the first electrical terminal to the second electrical terminal. The second position electrically connects the third electrical terminal to the second electrical terminal. The first vacuum bottle in the second vacuum bottle are longitudinally aligned. The mechanical linkage is interposed between the first and second vacuum bottles.

U.S. Pat. No. 8,467,166, issued on Jun. 18, 2013 to the present inventor, describes a circuit breaker and impedance grounding switch having a first electrical terminal, a second electrical terminal, a third electrical terminal, a first vacuum bottle with a pair of contactors therein, a second vacuum bottle with a pair of contactors therein, and a mechanically interlocked linkage being electrically interconnected to the second electrical terminal and being movable between a first stable position and a second stable position. One of the pair of contactors of the first vacuum bottle is connected to the first electrical terminal. One of the pair of contactors of the second vacuum bottle is electrically interconnected to the third electrical terminal. The linkage has a temporary position between the first and second stable positions electrically connecting simultaneously the first electrical terminal to the second electrical terminal and a third electrical terminal to the second electrical terminal.

Japanese Patent No. 2000341858, published on Dec. 8, 2000, describes a device and method for switching a power supply. This device switches the power supply received by a dual system at high speed by opening the pole of a primary switch at a current zero point formed out of current supplied by primary and secondary power systems. It then turns off the primary switch from a primary power system and steps down the voltage to normal operating voltage. After a pole closing command is sent from a switching control part to the switch of the secondary power system, the pole closing of the switch is completed. A pole opening command is outputted from the switching control part to a primary switch.

The pole is open so as to cut off current at a current zero point formed out of currents running from the primary and secondary current systems.

Japanese Patent No. 05174676, published on Jun. 26, 2000, teaches a power source change-over switch which simultaneously carries out change-over switching for selectively switching first and second power sources to connect them to the load. A first contact is provided between a first power source and a load. A second contact is switched complementarity to the first contact and is provided between the second power source and the load. The first contact is composed of a contact pair of a first fixed contact and a first moving contact. The second contact is composed of a contact pair of a second fixed contact and a second moving contact.

Japanese Patent No. 07161265, published on Jan. 26, 2004 describes an electrical power switching device that performs space saving without generating arc short-circuiting. A first auxiliary contactor is formed adjacent to a main contactor. A second auxiliary contactor is formed adjacent to a second main contactor when a switching command is given, the first main contactor is opened. Just after the first main contactor is opened and just before the auxiliary contactor is opened, a voltage drop is generated because the first current control element is inserted between the first power supply and the load.

Japanese Patent No. 2006019193, published on Jan. 19, 2006, describes a switching device that improves the insulation properties of the switching device to which a number of vacuum valves are connected serially. The device has a pair of contacts which are freely connected or disconnected. Two or more serially connected vacuum valves having an arc shield of intermediate potential is enclosed around the pair of contacts. Voltage share elements are connected in parallel between a contactor, the vacuum valve and the arc shield. An operating mechanism is provided for opening and closing the vacuum valve simultaneously.

Japanese Patent No. 11162303, published on Jun. 18, 1999, describes a switchgear intended to reduce the size of the switchgear. A fixed electrode for a main circuit is provided at one end of the inside of one vacuum ground vessel while a fixed electrode for a ground circuit is provided at the other end thereof. The number of each of the electrodes corresponds to the style of a single phase or multiphase system. A moving conductor connected to a load side conductor for each phase is insulation-supported between the fixed electrodes so that it can move linearly. A movable electrode for the main circuit is provided at one end of the moving conductor while the movable electrode for the ground circuit is provided at the other end thereof. A driver for moving the moving conductor is provided at the other side of the vacuum ground vessel.

European Patent Application No. 1 538 650, published on Jun. 8, 2005, teaches an isolator/circuit breaker device for electric substations. The device comprises a casing, at least one circuit breaker, at least one line isolator having a fixed isolator contact, a line isolator actuating shaft for actuating the line isolator, at least one earthing isolator, a circuit breaker actuating shaft for actuating at least one circuit breaker, and a lever connected to a conductor rod cooperating with movable circuit breaker contacts. The conductor rod engages with the fixed isolator contact in a closing position. The device further includes a resilient member cooperating with the conductor rod in order to transfer correct pressing loads to the movable contacts.

It is an object of the present invention to provide a distribution grounding switch that protects against overvoltages.

It is another object of the present invention to provide a distribution grounding switch which avoids damaging or destroying private and public property.

It is another object of the present invention to provide a distribution grounding switch which increases safety for electrical workers.

It is another object of the present invention to provide a distribution grounding switch that provides utilities with switching capabilities on distributed energy resources.

It is another object of the present invention to provide a distribution grounding switch that avoids overvoltages during transitions.

It is still another object of the present invention to provide a distribution grounding switch which provides a clear shut-down signal to the user.

It is still another object of the present invention to provide a distribution grounding switch that is managed by the utilities.

It is still further object of the present invention to provide a distribution grounding switch that causes transitions or commutations in a minimal amount of time.

It is a further object of the present invention to provide a distribution grounding switch that reduces prolonged transient overvoltages.

It is another object of the present invention to provide a distribution grounding switch that helps utility operators identify and clear transient faults.

It is still a further object of the present invention to provide a distribution grounding switch which improves distributed energy resource islanding.

It is still another object of the present invention to provide a distribution grounding switch that improves surge protection.

It is still another object of the present invention to provide a distribution grounding switch that improves distribution stability and reliability.

It is a further object of the present invention to provide a distribution grounding switch that reduces maintenance costs.

It is further object of the present invention to provide a distribution grounding switch that rapidly detects an undervoltage or shutdown.

It is still another object of the present invention to provide a distribution grounding switch that provides the utility with a means to de-energize the lateral from the primary source.

These and other objects and advantages of the present invention will become apparent from a reading of the attached specification and appended claims.

BRIEF SUMMARY OF THE INVENTION

The present invention is a transfer switch apparatus that has a first electrical terminal adapted for connection to a mains line, a second electrical terminal adapted for connection to a lateral line, a first vacuum bottle having a pair of contactors therein, a second vacuum bottle having a pair of contactors therein, and a mechanical linkage cooperative with one of the pair of contactors of the first vacuum bottle and one of the pair of contactors of the second vacuum bottle so as to cause the pair of contactors of the first vacuum bottle to close while generally simultaneously causing the pair contactors of the second vacuum bottle to open and so as to cause the pair of contactors of the first vacuum bottle to open and generally simultaneously caused the pair of contactors the second vacuum bottle to close. One of the pair of contactors of the first vacuum bottle is electrically connected or interconnected to the first electrical terminal. Another of the pair of contactors of the first vacuum bottle is electrically connected or interconnected to the second electrical terminal. One of the pair of contactors of the second vacuum bottle is electrically connected or interconnected to the first electrical terminal while another of the pair contactors of the second vacuum bottle is electrically connected or interconnected to ground or neutral.

One of the pair of the contactors of the first vacuum bottle has a first rod extending therefrom. One of the pair of contactors of the second vacuum bottle has a second rod extending therefrom. The mechanical linkage comprises a yoke pivotally mounted at a pivot point. The first rod is mounted to the yoke of one side of the pivot point. The second rod is mounted to the yoke on the opposite side of the pivot point. The mechanical linkage is positioned in a housing. The yoke is pivotally mounted to or within the housing.

An actuator is cooperative with the mechanical linkage. The actuator selectively acts on the mechanical linkage so as to cause the pair of contactors of the first vacuum bottle to close while the pair of contactors of the second vacuum bottle open. The actuator is cooperative with the mechanical linkage also so as to cause the pair of contactors the first vacuum bottle to open while the pair of contactors of the second vacuum bottle close. A magnetic actuator selectively applies an electromagnetic force to an actuator rod so as to cause the actuator rod to move in at least one direction. In particular, the actuator comprises a permanent magnet positioned adjacent to the magnetic actuator. The permanent magnet exerts a force on the actuator rod such that the actuator rod is retained in a fixed position after moving in the one direction. The magnetic actuator is cooperative with the permanent magnet or with the actuator rod so as to release the actuator rod from the permanent magnet such that the actuator rod moves in an opposite direction. A resilient member is connected or interconnected to the actuator rod so as to urge the actuator rod in the opposite direction.

The mechanical linkage has a pin member pivotally mounted thereto. The pin member is pivotally mounted to the actuator. One of the pair of contactors of the first vacuum bottle has a first rod. The pin member is pivotally mounted to only one of the sides of the yoke. The pin member is also pivotally mounted to the actuator rod. The actuator rod is a hinge member extending at an end of the actuator rod. The hinge manager member is pivotally connected to the pin member. An indicator is connected or interconnected to the pin member. The indicator indicates a position of the pair of contactors of either of the first and second vacuum bottles. The indicator has a display that indicates a position of the pair of contactors of either of the first and second vacuum bottles. A movement of the pin member causes the indicator to show the status of the grounding switch apparatus.

The present invention has a first current transformer connected between the first electrical terminal and the first and second vacuum bottles. The first current transformer is adapted to detect a variation of current flowing through the first current transformer. First current transformer is cooperative with the actuator such that the actuator causes a movement of each of the first and second contactors in the first and second vacuum bottles upon detection of the current condition in the first current transformer. A second current transformer is connected to at least one of the pair of contactors of the second vacuum bottle. The second current transformer is adapted to determine if a flow of current exists after the mechanical linkage causes the pair of contactors of the second vacuum bottle to close in order to ground or neutralize the current. An arrestor is cooperative with the pair of contactors of the first vacuum bottle so as to protect the mains line or the lateral line from overvoltages when the pair of contactors of the first vacuum bottle separate.

In the present invention, a shock absorber is connected to at least one of the sides of the yoke. The shock absorber is adapted to absorb shocks caused by movement of the first and second rods of the pair of contactors of the first and second vacuum bottles.

The magnetic actuator has a power source connected thereto so as to supply power to the magnetic actuator in order to move the actuator rod. The present invention further includes a sensor that senses the current flowing through the pair of contactors of the first and second vacuum bottles. The sensor is cooperative with the power source so as to actuate the magnetic actuator. An arm is connected or interconnected to the yoke. The arm is positioned outwardly of the housing. The arm is actuatable exterior of the housing and adapted to allow a person to manually move the yoke in order to position the pair of contactors of either the first and second vacuum bottles.

In the present invention, a mains line is connected to the first electrical terminal. A lateral line is connected to the second electrical terminal. A ground line is connected to one of the pair of contactors of the second vacuum bottle.

When the transfer switch of the present invention operates, the main breaker opens and disconnects the lateral from the main line. During transition, there is no overvoltage (since there is an arrestor that caps the voltage) and then ground closes so as to connect the lateral to ground. This gives a very clear shut-down signal to every generator connected to the lateral. In the eventuality that one or more of the generators stay connected, the voltage is zero. As such, there is no damage that can be done. The transfer switch apparatus can be installed on the grid so as to be managed by the utility. This gives the utility full control on the operation of the various distributed energy resources.

The commutation process begins with the ground closed and the main open. The opening spring keeps the ground vacuum interrupter closed and the main vacuum interrupter open. When the magnetic actuator is energized for a short period of time, with electricity provided by an outside source, the actuator rod will pull the opening spring and all the components will move. Once the rod within the magnetic actuator gets to the end of the stroke, the permanent magnet catches the rod and holds the rod in position without the need for maintaining the electrification of the magnetic actuator. At this time, the main breaker is closed and the ground is open.

The magnetic actuator is then energized once again for a short period of time but in an opposite direction so as to neutralize the permanent magnet and release the opening spring. This pulls the mechanism into an opposite direction. The shock absorber allows a soft end of the stroke and avoids bounces which could create re-strikes. The main breaker is now open and the ground closed. This is (1) a clear shut-down signal to every distributed energy resource that is connected to the lateral; (2) a safe environment for utility workers to work because the system is grounded; and (3) a way to prevent disasters and fires since the lines are de-energized.

The current transformer located at the top of the main breaker will detect any variation on the intensity of the current flowing through it. If there is a large increase in current, the current transformer will detect such a large increase and send a signal to the protection relay attached to and sends a tripping signal to open the magnetic actuator. The current transformer located between the two poles will inform, after the system is grounded, if there is still a flow of electricity. This is important information for utility and electrical workers that are working on the system.

The mechanical commutation process can take up to twenty milliseconds, either for closing or opening. As such, this "generally simultaneously" opening or closing can be construed as being instantaneously or up to a twenty millisecond delay. During the opening process, contacts on the main vacuum interrupter move apart. At the beginning of this movement, there is still flow of electricity. However, at some point the electricity flow stops. When the current stops flowing, temporary over-voltages will happen for a short period of time until the ground breaker closes. At this small period of time, if the transient overvoltages are too high, this could cause damage to the system. The arrestor limits these transient overvoltages during this period of time.

This foregoing Section is intended to describe, with particularity, the preferred embodiment of the present invention. It is understood that modifications to this preferred embodiment can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
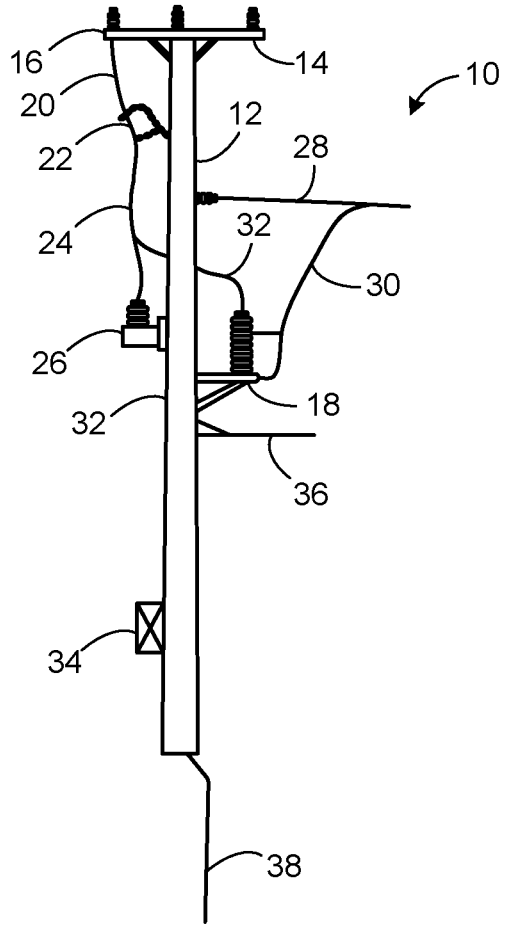
FIG. 1 is a side elevational view showing a utility pole having the distribution grounding switch of the present invention installed thereon.

Referring to FIG. 1, there is the system 10 of the present invention. The system 10 includes a utility pole 12 having a crossbeam 14 at a top thereof and a mains line 16 positioned on the crossbeam 14. The mains line 16 will be ultimately connected to a utility. The distribution grounding switch 18 is supported on the pole 12 below the crossbeam 14. Ultimately, a line 20 extends from the mains line 16 to a cutout or to a fuse 22. Line 24 extends from the fuse 22 to a potential transformer 26. Potential transformer 26 is supported on the pole 12 generally opposite to the distribution grounding switch 18. Lateral line 28 is connected to the pole 12. Lateral line 28 has a branch 30 that is connected to the distribution grounding switch 18. The mains line 16 is ultimately connected by branch line 32 to the distribution grounding switch 18. A control or relay 32 is supported by the pole 12 in a conventional manner A neutral or grounding line 36 is connected or interconnected to the distribution grounding switch 18. Ultimately, a ground rod 38 extends downwardly from the bottom of the pole 12.

Figure 2:
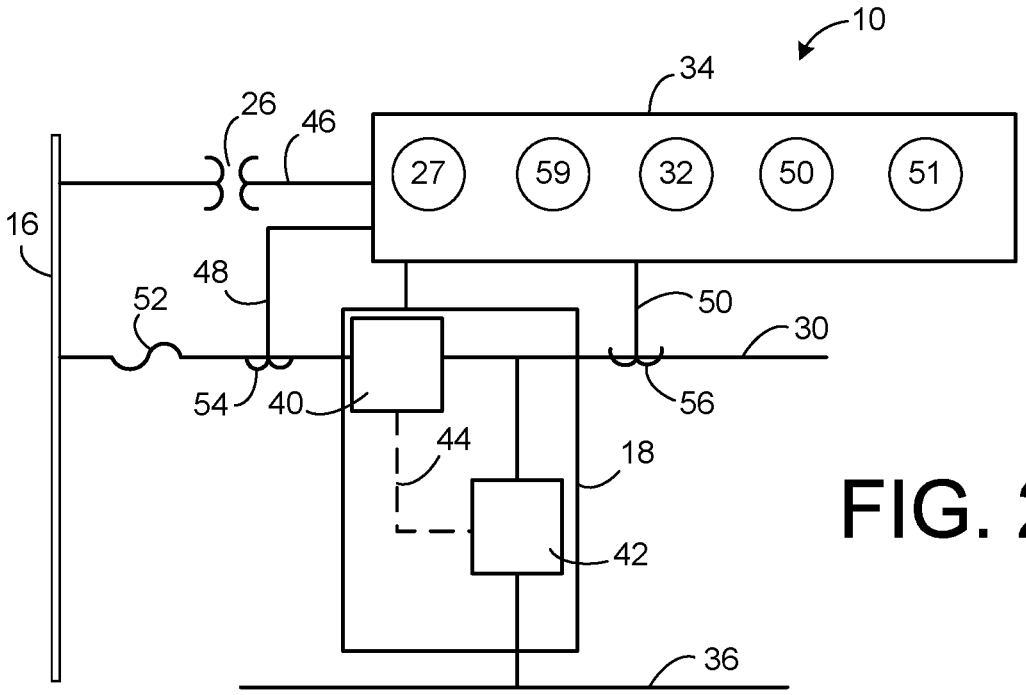
FIG. 2 is a schematic showing the system of the present invention as used in association with relays to the utility.

FIG. 2 shows the configuration of the system 10 of the present invention. System 10 allows the utility to have control and monitoring of the distributed energy resources. The distribution grounding switch 18 is illustrated as having a mains vacuum interlock 40 and a grounding vacuum interlock 42 therein. A mechanical linkage 44 connects the mains vacuum interrupter 40 to the grounding vacuum interrupter 42 (in the matter to be described hereinafter). Relay 34 is connected to a line 46 extending to the mains line 16. A potential transformer 26 is positioned on line 26. Relay 34 is connected by lines 48 and 50 to lateral line 30. Lateral line 30 has a fuse 52 thereon. Fuse 52 is located between the single phase grounding switch 18 and the mains line 16. A first current transformer 54 extends from line 48 to the relay 34. A second current transformer 56 is connected to the line 50 and extends to the relay 34. As will be described hereinafter, the first current transformer is located on top of the main breaker and will detect any variation on the intensity of the current flowing through it. If there is a huge increase in current, the current transformer 54 will detect it and send a signal to the protection relay attached to it. This ultimately sends a tripping signal to the magnetic actuator (to be described hereinafter). The second current transformer 56 is located between the two poles so as to determine if the system is grounded.

The distribution grounding switch 18 has the mains vacuum interrupter 40 connected to the mains line 16 and to the lateral line 30. The grounding vacuum interrupter 42 is connected to the mains line 16 and to ground line 36 and/or to ground rod 38. The mechanical linkage 44 will cause the mains vacuum interrupter 42 to open when a fault condition occurs. This generally simultaneously causes the grounding vacuum interrupter 42 to close so that the power from the mains line 16 flows to ground rod 38 or to neutral line 36. Alternatively, when a no-fault condition is sensed, then the mains vacuum interrupter 40 will remain closed so that power from the lateral line 30 will flow to the mains line 16.

Relay 34 is configured to sense the condition of power flowing to the utility from the distributed energy resources connected to lateral line 30. Relay 34 will inform the utility of an under-voltage 27, an over-voltage 59, a directional power 32 and an inverse time over-current 50 and 51. As such, relay 34 facilitates the ability of the utility to send the shutdown signal to the distribution grounding switch 18 and ultimately to the distributed energy resources connected to the lateral line 30. As such, if it is necessary to shut down the distributed energy resources, the shutdown signal is sent through the mains line 16 to the distribution grounding switch 18 so that power is no longer transmitted from the distributed energy resource along lateral line 30 to the mains line 16 and so that the power flows to ground.

Figure 3:
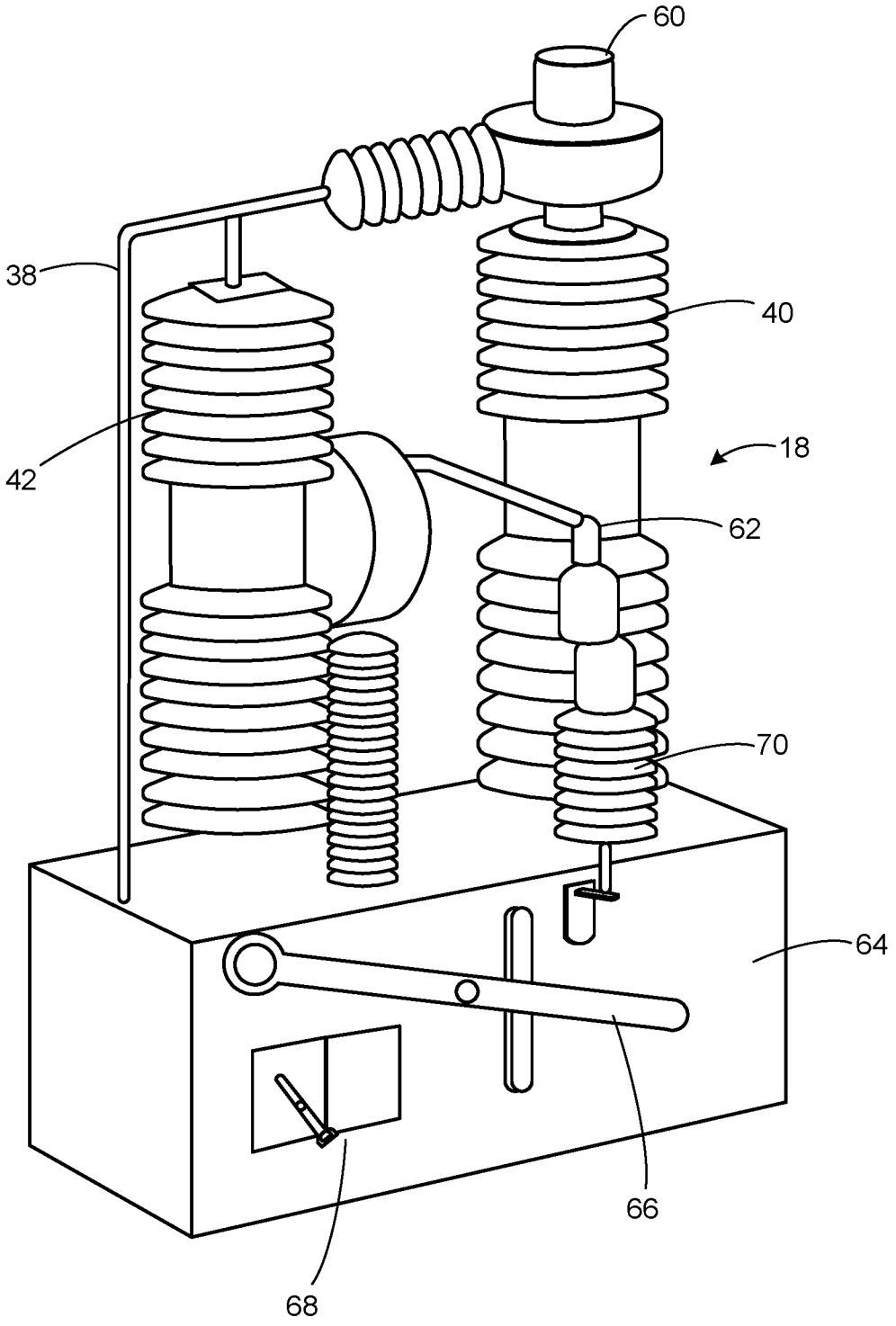
FIG. 3 is an upper perspective view of the distribution grounding switch of the present invention.

FIG. 3 shows the distribution grounding switch 18 of the present invention. As can be seen, the distribution grounding switch 18 has a first electrical terminal 60 connected to the mains line 16. There is a second electrical terminal 62 connected to the lateral line 30. The mains vacuum interrupter 40 is connected to the first electrical terminal 60 and the second electrical terminal 62 so that power can flow therebetween. The grounding vacuum interrupter 42 is illustrated as connected to the second electrical terminal 62 and connected to ground bar 38. Alternatively, as shown in FIG. 2, the grounding vacuum interrupter 42 can also be connected to a neutral or grounding line.

FIG. 3 shows that there is a housing 64 positioned at the bottom of the mains vacuum interrupter 40 and the grounding vacuum interrupter 42. Housing 44 will contain the mechanical linkage therein (to be described hereinafter). An arm 66 extends outwardly of the housing 64. The arm 66 will be connected or interconnected to the linkage within the interior of the housing 44 (to be described hereinafter). The arm 66 is actuatable exterior of the housing 64 so as to allow a person to manually move the mechanical linkage in order to set a position of the pair of contactors of either the mains vacuum interrupter 40 or the grounding vacuum interrupter 42. An indicator 68 is pivotally mounted on the exterior of the housing 64. Indicator 68 is a display that indicates a position of the pair of contactors of either the mains vacuum interrupter 44 or the grounding vacuum interrupter 42. A movement of the indicator 68 shows the status of the distribution grounding switch 18.

An arrestor 70 is connected to the electrical terminal 62. Arrestor 70 is cooperative with the pair of contactors of the mains vacuum interrupter 40 or with a pair of contactors of the grounding vacuum interrupter so as to protect the mains line or the lateral line from transient overvoltages when the pair of contactors of the mains vacuum interlock 40 separate.

Figure 4:
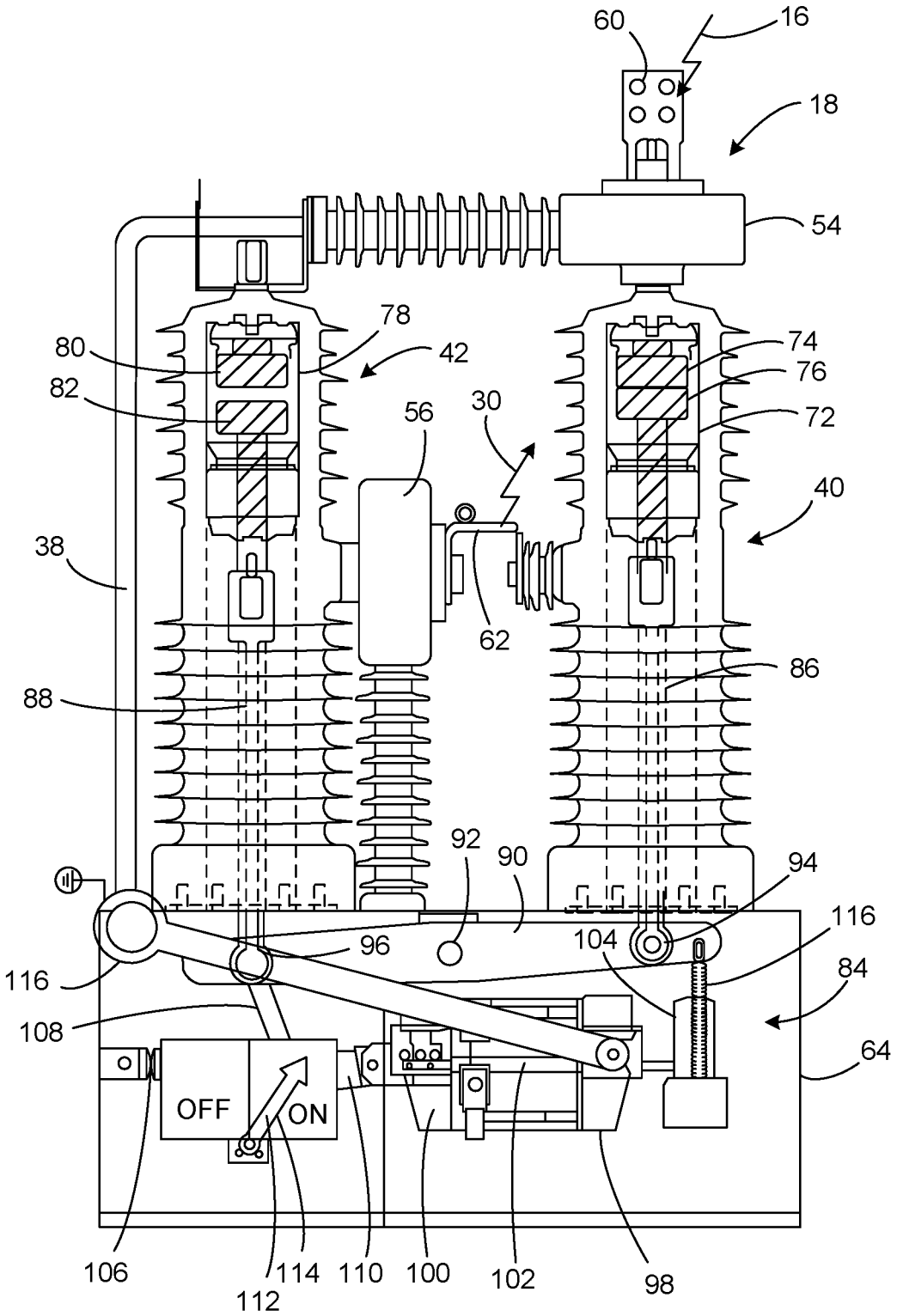
FIG. 4 is a cross-sectional view showing the distribution grounding switch of the present invention with the mains closed and the grounding open.

FIG. 4 is a cross-sectional view of the distribution grounding switch 18 of the present invention. This distribution grounding switch 18 has a first electrical terminal 60 adapted to be connected to the mains line 16. The first current transformer 54 is connected to the first terminal 60. The second electrical terminal 62 is adapted to be connected to the lateral 30. A second current transformer 56 is positioned adjacent to the second electrical terminal 62. The mains vacuum interrupter 40 comprises a first vacuum bottle 72 having a pair of contactors 74 and 76 therein. Contactor 74 is electrically connected or interconnected to the first electrical terminal 60. The contactor 76 is electrically connected or interconnected to the second electrical terminal 62.

The grounding vacuum interrupter 42 has a second vacuum bottle 78 therein. Second vacuum bottle 78 has a pair of contactors 80 and 82 therein. Contactor 80 is electrically connected to ground bar 38. The second contactor 42 will ultimately be electrically connected or interconnected to the second electrical terminal 62.

A mechanical linkage 84 is positioned in the interior of housing 64. Mechanical linkage 84 is cooperative with one of the contactors 74 and 76 of the first vacuum bottle 72 and one of the pair of contactors 80 and 82 of the second vacuum bottle 78 so as to cause the pair of contactors 74 and 76 of the first vacuum bottle 72 to close while generally simultaneously causing the pair of contactors 80 and 82 of the second vacuum bottle 78 to open (as shown in FIG. 4). In this configuration, power from the lateral line 32 can flow to and from the mains line 16. In this circumstance, the system is operating properly and power from the distributed energy resources are being delivered to the utility.

The contactor 76 of the second vacuum bottle 72 has a rod 86 extending therefrom. Contactor 82 of the second vacuum bottle 78 has a rod 88 extending therefrom. The mechanical linkage 84 includes a yoke 90 pivotally mounted at a pivot point 92 within the housing 64. The rod 86 has one end mounted at pivot 94 the yoke 90 on one side of the pivot 92. The rod 88 is connected to pivot 96 of the yoke 90 on an opposite side of the pivot point 92. Yoke 90 operates in a seesaw manner such that when a downward force is applied to the yoke 90 on one side of the pivot point 92, the opposite side of the yoke 90 will create an upward force. In FIG. 4, it can be seen that the yoke 90 is pivoted such that the rod 86 moves upwardly so as to close the pair of contactors 74 and 76 of the first vacuum bottle 72 generally simultaneously with the opening of the pair of contactors 80 and 82 of the second vacuum bottle 78.

The distribution grounding switch 40 has an actuator 98 that is cooperative with the mechanical linkage 84. The actuator 98 selectively acts on the mechanical linkage 84 so as to cause the pair of contactors 74 and 76 of the first vacuum bottle 72 to close while the pair of contactors 80 and 82 of the second vacuum bottle 78 open. The actuator 98 includes a magnetic actuator 100 that selectively applies an electromagnetic force onto an actuator rod 102 so as to cause the actuator rod 92 to move in one direction. In FIG. 4, it can be seen that the magnetic actuator 100 has caused the actuator rod 102 to move toward the right such that an end of the actuator rod 102 engages with a permanent magnet 104. Permanent magnet 104 is positioned adjacent to the magnetic actuator 100. The permanent magnet 104 exerts a magnetic force onto the actuator rod 102 such that the actuator rod 102 is retained in a fixed position after moving in one direction. The magnetic actuator 100 is cooperative with the permanent magnet 104 or with the actuator rod 102 so as to release the actuator rod 102 from the permanent magnet 100 and such the actuator rod 102 can move in an opposite direction. A resilient member 106 is connected or interconnected to the actuator rod 102 so as to urge the actuator rod in the opposite direction. The resilient member 106 can be a spring mounted to a side of the housing 64.

The mechanical linkage 84 has a pin member 108 pivotally mounted thereto. The pin member 104 will be pivotally mounted to the actuator 98. In particular, the pin member 108 (as will be described hereinafter) will be connected by a pivoting linkage to the actuator rod 102. The pin member 108 is illustrated as pivotally mounted to only one side of the yoke 90. Pin member 108 is particularly shown as connected to pivot 96 of yoke 90. Ultimately, pin member 108 will move upwardly (with the movement of the actuator rod 102) so as to urge the rod 88 upwardly such that the contactors 80 and 82 of the ground vacuum interlock 42 to close. In particular, the actuator rod 102 will have a hinge member 110 pivotally mounted to an end of the actuator rod 102. As will be described hereinafter, the hinge member 110 will also be pivotally connected to the pin member 108 at an end opposite the pivot 96 of the yoke 90.

An indicator 112 is connected or interconnected to the pin member 108. The indicator 112 has a display 114 that indicates a position of the pair of contactors of either of the first vacuum bottle 72 or the second vacuum bottle 78. A movement of the pin member 108 can cause the indicator 112 to show a status of the distribution grounding switch 40.

The first current transformer 54 is connected between the first electrical terminal 60 and the first and second vacuum bottles 72 and 74. The first current transformer 54 is adapted to detect a variation of current flowing through the first current transformer 54. The first current transformer 54 is cooperative with the actuator 98 such that the actuator causes a movement of a contactor of each of the pair of contactors in the first and second vacuum bottle 72 and 78 upon detection of a current condition in the first current transformer 54.

The second current transformer 56 is connected to at least one of the pair of contactors of the second vacuum bottle 78. The second current transformer 56 is adapted to determine if a flow of current exists after the mechanical linkage 84 causes the pair of contactors 80 and 82 of the second vacuum bottle 78 to close in order to ground or neutralize the current.

A shock absorber 116 is connected to at least one of the sides of the yoke 90. The shock absorber 116 is in the nature of a spring that is adapted to absorb shock caused by the movement of the first rod 86 or the second rod 88.

The magnetic actuator will have a power source connected thereto so as to supply power to the magnetic actuator 100 in order to move the actuator rod 102. A sensor (in the nature of the first current transformer 54 the second transformer 56) will sense the current flowing through the pair of contactors of the first vacuum bottle 72 and the second vacuum bottle 78. The sensor is cooperative with the power source so as to actuate the magnetic actuator 100.

An arm 116 is connected or interconnected to the yoke 90. The arm 116 is positioned outwardly of one side of the housing 64. The arm 116 is actuatable exterior of the housing 64 and adapted to allow a person to manually move the yoke 90 in order to set a position of the pair of contactors of either of the first vacuum bottle 72 or the second vacuum bottle 78. The arm 116 is also cooperative with the pin member 108 so as to allow the indicator 112 to appropriately move on the display 114.

Figure 5:
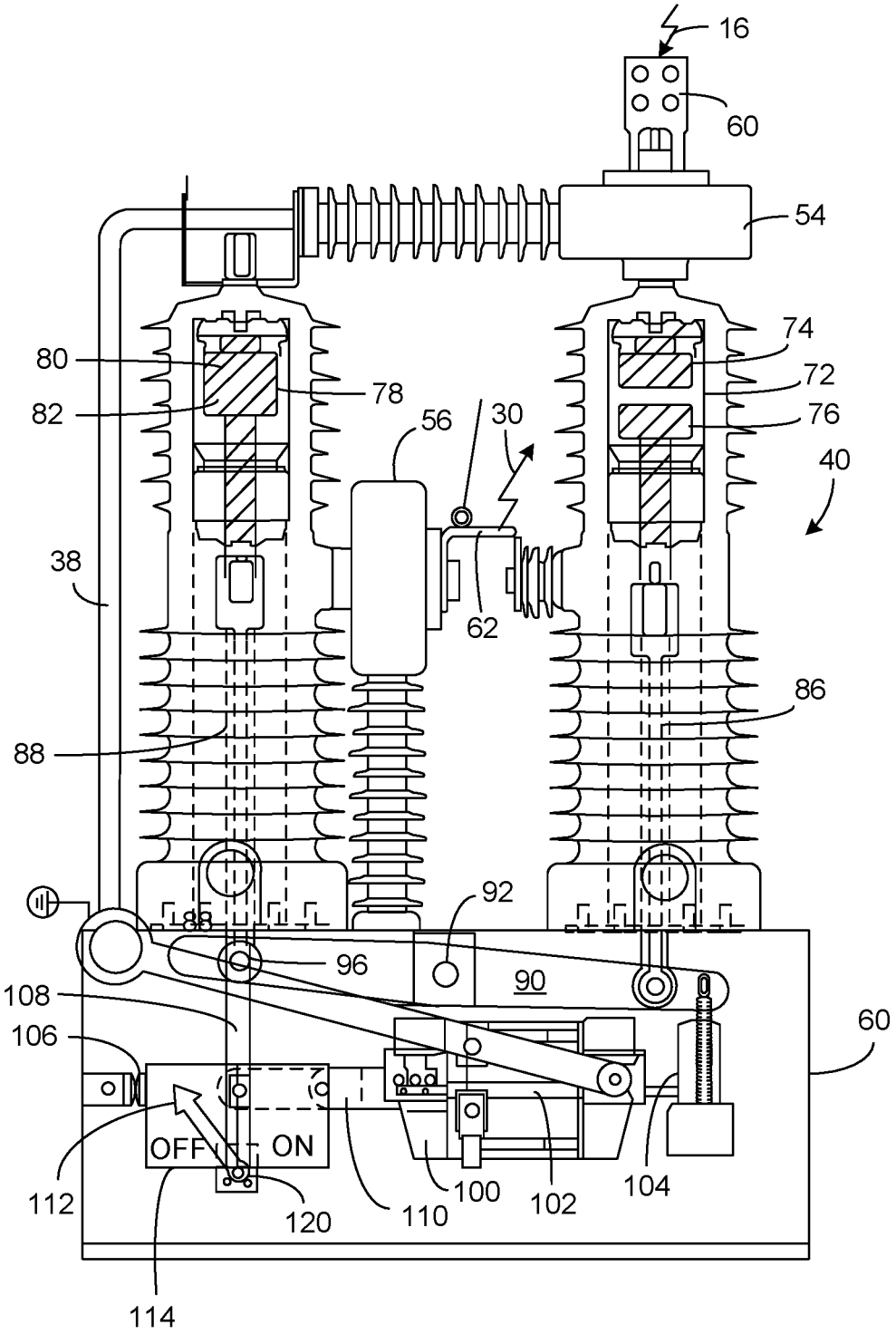
FIG. 5 is a cross-sectional view of the distribution grounding switch of the present invention with the mains open and the grounding closed.

In FIG. 4, it can be seen that power is flowing through the lateral line 30 and through the mains line 16. In this configuration, if power is generated by distributed energy resource, it can be delivered through the second electrical terminal 62 and into the mains vacuum interrupter 40. Since the contactors 74 and 76 of the first vacuum bottle 72 are closed, this power will flow therethrough and to the first electrical terminal 60. If the transformer 54 should sense a fault in the current or sense a signal from the utility to close the distributed energy resource or resources, the contactor 74 and 76 in the first vacuum bottle 72 will separate while generally simultaneously the contactors 80 and 82 of the first second vacuum bottle 78 will close in the manner shown in FIG. 5 hereinafter.

Figure 6:
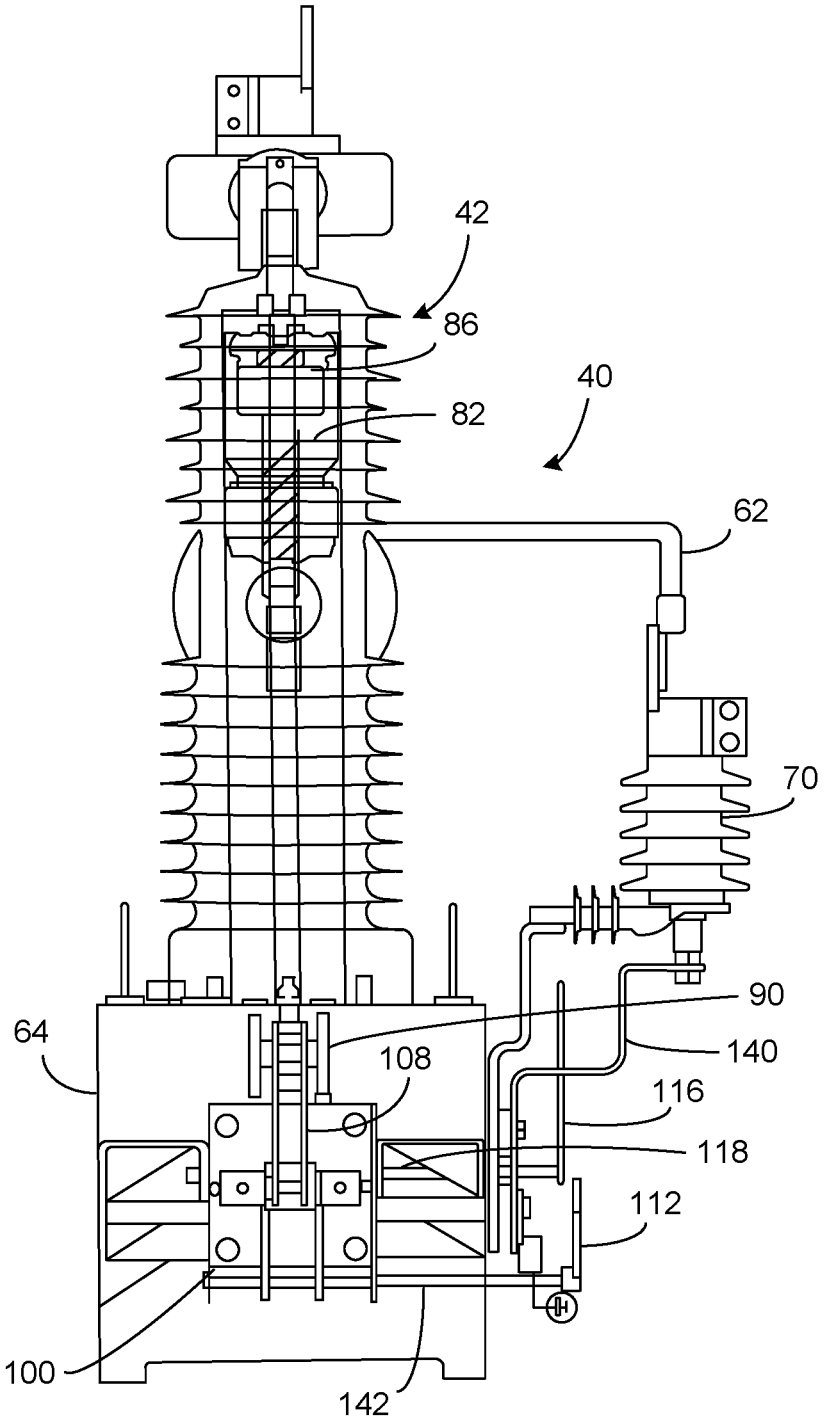
FIG. 6 is a cross-sectional end view of the distribution grounding switch of the present invention of FIG. 5.

FIG. 6 shows the distribution grounding switch 40 in the configuration in which power from the mains line 16 passes through ground bar 38 and in which the power from the distributed energy resource from the lateral line 30 of the distributed energy resource passes to ground. In particular, it can be seen that the pair of contactors 74 and 76 of the first vacuum bottle 72 are separated. As a result, current from the first electrical terminal 60 will not flow through the contactors 74 and 76 to the first rod 86. Because the contactors 74 and 76 are separated, power to or from the main 16 will not flow from or to the distributed energy resource by the lateral line 30 extending from the second electrical terminal 62. Under the circumstances where the first current transformer 54 should detect a fault condition or detect a signal from the utility, the first current transformer 54 will transmit a signal to the magnetic actuator 100 so as to cause the actuator rod 102 to be released from the permanent magnet 104 and moved to the left. In particular, the resilient member 106 will urge the actuator rod 102 away from the permanent magnet 106. As such, the pin member 108 will pivot at pivot 96 so as to extend generally vertically. The hinge member 110 extends linearly. As such, the pin member 108 will urge the yoke 90 to pivot on pivot point 92 such that the second rod 88 moves upwardly so as to cause the contactors 80 and 82 of the second vacuum bottle 78 to close. In this configuration, power from the distributed energy resource will flow to ground rod 34. Additionally, the power from the mains line 16 will flow to the ground rod 38.

Since the pin member 108 is in a vertical configuration, this will cause the indicator 112 of display 114 to move so as to indicate (exterior of housing 60) that the system is "off". In particular, the pin member 108 acts on a pivot 120 so as to cause the indicator 112 to move. The second current transformer 56 will now sense that there is no current flowing through the distribution grounding switch 40. As such, this will provide information to workers that the system is in a condition to be worked on. As such, this avoids potential electrocution.

FIG. 6 shows a side view of the distribution grounding switch 40 of the present invention. In particular, FIG. 6 shows the configuration of the arrestor 70. The mechanical commutation process can take up to twenty milliseconds for either opening or closing. During the opening process, the contacts 74 and 76 of the mains vacuum interrupter 40 move apart. At the beginning of this movement, there is still flow of electricity. When the current stops flowing, temporary overvoltages will occur for small periods of time until the contactors 80 and 82 of the ground vacuum interrupter 42 close. If the transient overvoltages are too high, the can cause damage to the system. The arrestor 70 will limit transient overvoltages during this time. The arrestor 70 is connected to the second electrical terminal 62 and supported by frame 140. The arrestor 70 extends outwardly of the housing 64.

FIG. 6 further shows that the magnetic actuator 100 is located within the interior of housing 64. The magnetic actuator 100 will have a rod 142 extending therefrom and outwardly of the housing. Rod 142 is cooperative with the pin member 108 so as to cause the movement of the indicator 112 in the manner described herein previously. Similarly, the arm 116 is illustrated as extending outwardly of the housing 64. Arm 116 also has a rod 118 extending into the housing 64 so as to act upon the pin member 108 in order to move the yoke 90 in the desired direction. As such, when a force is applied to the arm 116 exterior of the housing 64, the user can selectively move the contactors between their respective positions.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A grounding switch apparatus comprising:

a first electrical terminal adapted for connection to a mains line of a utility;

a second electrical terminal adapted for connection to a lateral line;

a first vacuum bottle having a pair of contactors therein, one of the pair of contactors of said first vacuum bottle being electrically connected or interconnected to said first electrical terminal, another of said pair of contactors of said first vacuum bottle electrically connected or interconnected to said second electrical terminal;

a second vacuum bottle having a pair of contactors therein, one of the pair of contactors of said second vacuum bottle being electrically connected or interconnected to said first electrical terminal or to said second electrical terminal, another of the pair of contactors of said second vacuum bottle being electrically connected or interconnected to ground or neutral;

a mechanical linkage cooperative with one of the pair of contactors of said first vacuum bottle and one of the pair of contactors of said second vacuum bottle so as to cause the pair of contactors of said first vacuum bottle to close while generally simultaneously causing the pair of contactors of said second vacuum bottle to open and so as to cause the pair of contactors of said first vacuum bottle to open and generally simultaneously cause the pair of contactors of said second vacuum bottle to close;

an actuator cooperative with said mechanical linkage, said actuator selectively acting on said mechanical linkage so as to cause the pair of contactors of said first vacuum bottle to close while the pair of contactors of said second vacuum bottle open or to cause the pair of contactors of said first vacuum bottle to open while the pair of contactors of the second vacuum bottle close;

a first current transformer connected between said first electrical terminal and said first and second vacuum bottles, said first current transformer adapted to detect a variation of a current flowing through said first current transformer, said first current transformer being cooperative with said actuator such that said actuator causes a movement of a contactor of each of said pair of contactors in said first and second vacuum bottles upon detection of a current condition in said first current transformer; and a second current transformer connected to at least one of the pair of contactors of said second vacuum bottle, said second current transformer adapted to determine if a flow of current exists after said mechanical linkage causes the pair of contactors of said second vacuum bottle to close in order to ground or neutralize the current.

2. The grounding switch apparatus of claim 1, one of the pair of contactors of said first vacuum bottle having a first rod extending therefrom, one of the pair of contactors of said second vacuum bottle having a second rod extending therefrom, said mechanical linkage comprising:

a yoke pivotally mounted at a pivot point, the first rod mounted to said yoke on one side of the pivot point, the second rod being mounted to said yoke on an opposite side of the pivot point.

3. The grounding switch apparatus of claim 2, further comprising:

a housing in which said mechanical linkage is positioned, said yoke being pivotally mounted within said housing.

4. The grounding switch apparatus of claim 3, further comprising:

an arm connected or interconnected to said yoke, said arm positioned outwardly of one side of said housing, said arm being actuatable exterior of said housing and adapted to allow a person to manually move said yoke in order to set a position of the pair of contactors of either of said first and second vacuum bottles.

5. The grounding switch apparatus of claim 1, said actuator comprising:

a magnetic actuator that selectively applies an electromagnetic force to an actuator rod so as to cause the actuator rod to move in at least one direction.

6. The grounding switch apparatus of claim 5, said actuator further comprising:

a permanent magnet positioned adjacent said magnetic actuator, said permanent magnet exerting a magnetic force on said actuator rod such that the actuator rod is retained in a fixed position after moving in the one direction.

7. The grounding switch apparatus of claim 6, said magnetic actuator being cooperative with said permanent magnet or with the actuator rod so as to release the actuator rod from the permanent magnet such that the actuator rod moves in an opposite direction.

8. The grounding switch apparatus of claim 7, further comprising:

a resilient member connected or interconnected to the actuator rod so as to urge the actuator rod in the opposite direction.

9. The grounding switch apparatus of claim 1, said mechanical linkage having a pin member pivotally mounted thereto, the pin member being pivotally mounted to said actuator.

10. The grounding switch apparatus of claim 9, one of the pair of contactors of said first vacuum bottle having a first rod extending therefrom, one of the pair of contactors of said second vacuum bottle having a second rod extending therefrom, said mechanical linkage comprising:

a yoke pivotally mounted at a pivot point, the first rod being mounted to said yoke on one side of the pivot point, the second rod being mounted to said yoke on an opposite side of the pivot point, said pin member being pivotally mounted to only one of the sides of said yoke.

11. The grounding switch apparatus of claim 10, further comprising:

an actuator cooperative with said mechanical linkage, said actuator selectively acting on said mechanical linkage so as to cause the pair of contactors of said first vacuum bottle to close while the pair of contactors of said second vacuum bottle open or to cause the pair of contactors of said first vacuum bottle to open while the pair of contactors of said second vacuum bottle close, said actuator comprising:

a magnetic actuator that selectively applies an electromagnetic force to an actuator rod so as to cause the actuator rod to move in at least one direction, said pin member being pivotally mounted to said actuator rod.

12. The grounding switch apparatus of claim 11, said actuator rod having a hinge member extending at an end of said actuator rod, said hinge member being pivotally connected to said pin member.

13. The grounding switch apparatus of claim 11, further comprising:

an indicator connected or interconnected to said pin member, said indicator having a display that indicates a position of the pair of contactors of either of said first and second vacuum bottles, a movement of said pin member causing said indicator to show a status of the grounding switch apparatus.

14. The grounding switch apparatus of claim 1, further comprising:

an arrestor cooperative with the pair of contactors of the said first vacuum bottle so as to protect the mains line or the lateral line from overvoltages when the pair of contactors of said first vacuum bottle separate.

15. A grounding switch apparatus comprising:

a first electrical terminal adapted for connection to a mains line of utility;

a second electrical terminal adapted for connection to a lateral line;

a first vacuum bottle having a pair of contactors therein, one of the pair of contactors of said first vacuum bottle being electrically connected or interconnected to said first electrical terminal, another of said pair of contactors of said first vacuum bottle electrically connected or interconnected to said second electrical terminal;

a second vacuum bottle having a pair of contactors therein, one of the pair of contactors of said second vacuum bottle being electrically connected or interconnected to said first electrical terminal or to said second electrical terminal, another of the pair of contactors of said second vacuum bottle being electrically connected or interconnected to ground or neutral; and a mechanical linkage cooperative with one of the pair of contactors of said first vacuum bottle and one of the pair of contactors of said second vacuum bottle so as to cause the pair of contactors of said first vacuum bottle to close while generally simultaneously causing the pair of contactors of said second vacuum bottle to open and so as to cause the pair of contactors of said first vacuum bottle to open and generally simultaneously cause the pair of contactors of said second vacuum bottle to close, one of the pair of contactors of said first vacuum bottle having a first rod extending therefrom, one of the pair of contactors of said second vacuum bottle having a second rod extending therefrom, said mechanical linkage comprising:

a yoke pivotally mounted at a pivot point, the first rod mounted to said yoke on one side of the pivot point, the second rod being mounted to said yoke on an opposite side of the pivot point; and a shock-absorber connected to at least one of the sides of said yoke, said shock absorber adapted to absorb shocks caused by a movement of the first and second rods of said pair of contactors of said first and second vacuum bottles.

16. A grounding switch apparatus comprising:

a first electrical terminal adapted for connection to a mains line of utility;

a second electrical terminal adapted for connection to a lateral line;

a first vacuum bottle having a pair of contactors therein, one of the pair of contactors of said first vacuum bottle being electrically connected or interconnected to said first electrical terminal, another of said pair of contactors of said first vacuum bottle electrically connected or interconnected to said second electrical terminal;

a second vacuum bottle having a pair of contactors therein, one of the pair of contactors of said second vacuum bottle being electrically connected or interconnected to said first electrical terminal or to said second electrical terminal, another of the pair of contactors of said second vacuum bottle being electrically connected or interconnected to ground or neutral; and a mechanical linkage cooperative with one of the pair of contactors of said first vacuum bottle and one of the pair of contactors of said second vacuum bottle so as to cause the pair of contactors of said first vacuum bottle to close while generally simultaneously causing the pair of contactors of said second vacuum bottle to open and so as to cause the pair of contactors of said first vacuum bottle to open and generally simultaneously cause the pair of contactors of said second vacuum bottle to close;

an actuator cooperative with said mechanical linkage, said actuator selectively acting on said mechanical linkage so as to cause the pair of contactors of said first vacuum bottle to close while the pair of contactors of said second vacuum bottle open or to cause the pair of contactors of said first vacuum bottle to open while the pair of contactors of the second vacuum bottle close, said actuator comprising:

a magnetic actuator that selectively applies an electromagnetic force to an actuator rod so as to cause the actuator rod to move in at least one direction, said magnetic actuator having a power source connected thereto so as to supply power to said magnetic actuator in order to move the actuator rod; and a sensor that senses a current flowing through the pair of contactors of said first and second vacuum bottles, said sensor cooperative with said power source so as to actuate said magnetic actuator.

* * * * *